US005399257A

United States Patent [19]

Russ et al.

[11] Patent Number: 5,399,257

[45] Date of Patent: Mar. 21, 1995

[54] COKE INHIBITING PROCESS USING GLASS BEAD TREATING

[75] Inventors: Michael B. Russ, Villa Park; Chi-Chu D. Low, Lisle; Jeffry T. Donner, Lake Zurich, all of Ill.

[73] Assignee: UOP, Des Plaines, Ill.

[21] Appl. No.: 159,643

[22] Filed: Nov. 30, 1993

Related U.S. Application Data

[63] Continuation-in-part of Ser. No. 812,500, Dec. 23, 1991, abandoned.

[51] Int. Cl.[6] ..... C10G 9/32

[52] U.S. Cl. ..... 208/48 R; 134/8; 148/240; 148/279; 427/452

[58] Field of Search ..... 134/8; 208/48 R; 148/240, 279; 427/452

[56] References Cited

U.S. PATENT DOCUMENTS

| | | | |
|---|---|---|---|
| 1,566,911 | 12/1925 | Nelson | 427/453 |
| 2,347,527 | 4/1944 | Vanderbilt | 208/48 |
| 2,793,173 | 5/1957 | Fritz | 208/48 |
| 3,090,746 | 5/1963 | Markert et al. | 208/48 |
| 3,592,762 | 7/1971 | Blaser et al. | 208/48 |
| 3,607,343 | 9/1971 | Longo | 427/452 |
| 3,641,190 | 2/1972 | Kivlen | 208/48 |
| 3,704,333 | 11/1972 | Spangler | 208/48 |
| 3,939,613 | 2/1976 | Ayers | 51/220 |
| 4,099,990 | 7/1978 | Brown | 148/6.35 |
| 4,579,596 | 4/1986 | Murzyn | 134/8 |
| 4,938,993 | 7/1979 | Bennett | 148/279 |
| 5,108,512 | 4/1992 | Goffnett | 134/8 |

OTHER PUBLICATIONS

Microbeads Glass Shot, Catahote/Ferrocorp Spec. Sheet Dec. 1979.

Metals Handbook 9th Ed vol. 5 Surface Cleaning Finished Coating, Am Society Metals 87.

*Primary Examiner*—Helane Myers

*Attorney, Agent, or Firm*—Thomas K. McBride; John G. Tolomei

[57] ABSTRACT

Hydrocarbon conversion processes having a susceptibility to coke formation on the internal surfaces of processing equipment are improved by inhibiting the formation of coke with the use of a glass bead treatment for the metal surfaces. After treating with ordinary glass bead cleaning methods, metal surfaces are found to inhibit coke formation. The glass bead treatment is easily performed and, therefore, offers advantages over other chemical treatments for the deposition of silica on reactor internals.

8 Claims, 1 Drawing Sheet

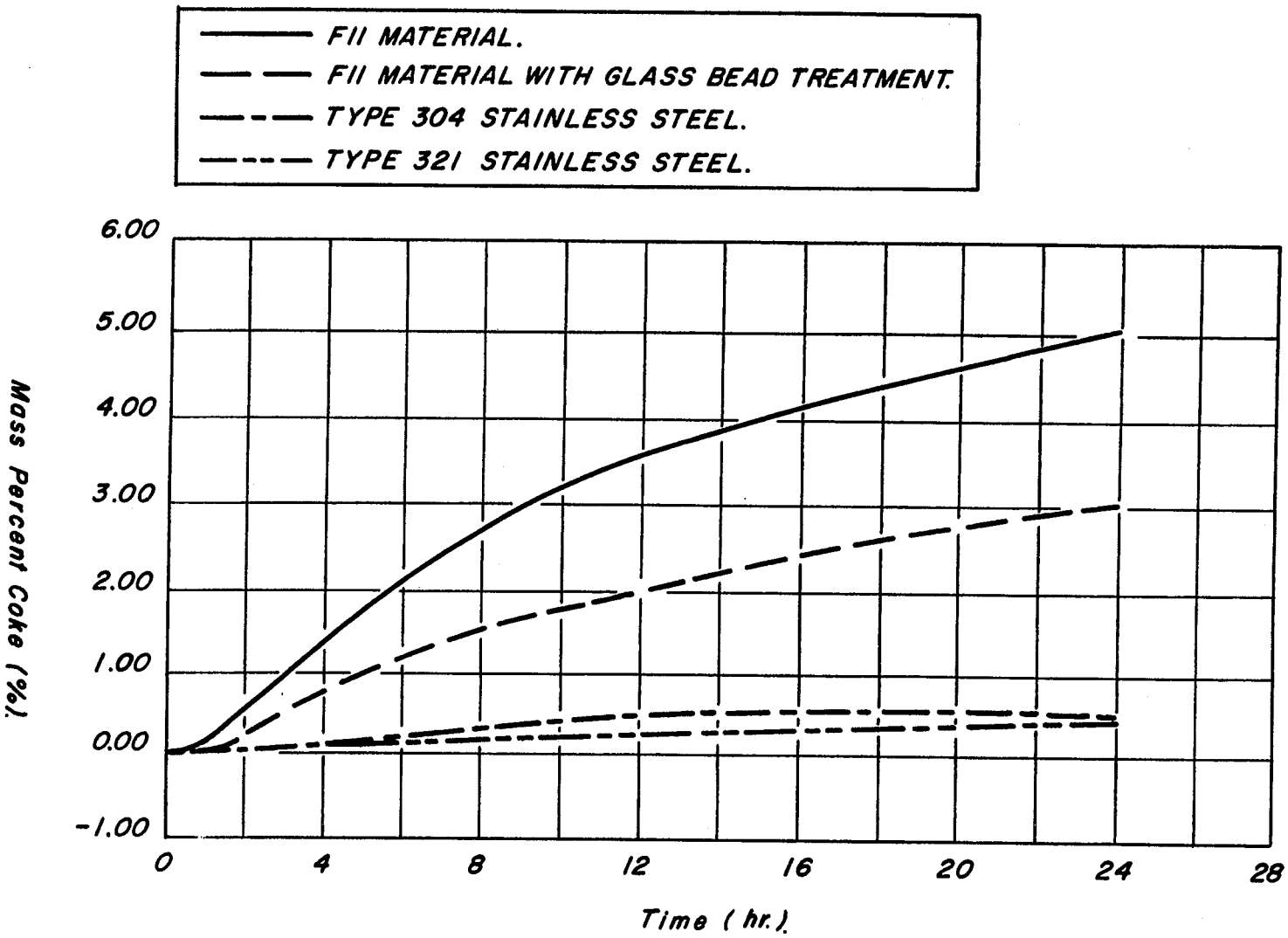
F/I MATERIAL.
F/I MATERIAL WITH GLASS BEAD TREATMENT.
TYPE 304 STAINLESS STEEL.
TYPE 321 STAINLESS STEEL.
6.00
5.00
4.00
3.00
2.00
1.00
0.00
-1.00
Mass Percent Coke (%).
0
4
8
12
16
20
24
28
Time (hr.).

COKE INHIBITING PROCESS USING GLASS BEAD TREATING

CROSS REFERENCE TO RELATED APPLICATIONS

The application is a continuation-in-part of application U.S. Ser. No. 812,500, filed Dec. 23, 1991, now abandoned.

FIELD OF THE INVENTION

The present invention relates to methods of inhibiting coke formation on metal surfaces in processes for convening hydrocarbon-containing feedstreams. More specifically, this invention relates to methods for treating metal surfaces in processes for the conversion of hydrocarbonaceous compounds.

BACKGROUND OF THE INVENTION

Metal surfaces such as reactor walls and internals, heat exchanger tubes, and other piping and equipment used in conversion of hydrocarbon-containing feedstreams often become coated with coke. The type of reactions in which such coking can occur are well known. Such reactions include thermal cracking for the production of olefins, in particular ethylene, reforming and catalytic cracking for the production of motor fuels and cyclization reactions for the production of aromatics are just of few of such processes. In such reactions, coke formed as a by-product usually coats the inside of a substantial portion of the metal surfaces in the environment of the convened hydrocarbon products or reactants.

Coke accumulation has a number of drawbacks. Accumulated coke reduces the diameter of piping and flow areas within the vessel causing reduced reactor throughputs or increased pressure drops. The insulating effects of coke accumulation pose special problems in heat exchanger tubes where additional heat input and higher temperatures are needed to compensate for the presence of the coke. Higher tubewall temperatures cause faster deterioration of many heat exchanged surfaces. In addition, in some processes, large chunks of coke can break off of metal surfaces and jam or block downstream process equipment. Therefore, whether as part of routine maintenance, or an emergency shutdown, coke formation complicates the operation of hydrocarbon conversion processes.

A number of methods are known for reducing coke formation in hydrocarbon conversion processes. One such method is steam dilution of hydrocarbon vapors to reduce the level of homogeneous coking. Sulfur compounds will also act to inhibit coking in many processes. However, both steam and sulfur can deleteriously affect many hydrocarbon conversion processes. Excess water in the form of steam deactivates many catalyst compositions. Similarly, sulfur poisons a variety of catalyst systems that are used in coke forming processes.

Other methods of inhibiting coke formation include chemical treatment of metal surfaces in hydrocarbon conversion processes. It is known from U.S. Pat. No. 4,099,990 that the application of silicon compounds to substrate surfaces can inhibit coking of such surfaces in many hydrocarbon conversion processes. The '990 patent teaches the chemical vapor deposition of an alkoxysilane to produce a silicon film on metal surfaces. By this method a the silica film on metals substrates.

The multiple step procedure makes deposition of the silica film a complicated process. Therefore, use of the deposition procedure can add considerable expense to the manufacture of processing equipment. In addition to cost, the availability of equipment and experienced personnel makes the procedure impractical for many field installation situations. A silica deposition technique, readily adaptable to field application, would facilitate the use of such deposition techniques in many hydrocarbon conversion processes that require field fabrication, field assembly or on site repair of equipment and vessel internals. As a result any method of more easily forming a coke inhibiting layer on a metal surface would be highly useful.

BRIEF DESCRIPTION OF THE INVENTION

It has been surprisingly and unexpectedly found that a metal surface treated by a glass bead cleaning procedure resists coking during exposure to hydrocarbon conversion conditions. The ability of a glass bead cleaning procedure to resist coking was totally unexpected. Those promoting glass bead treatment as a method of cleaning metals tout it as non-contaminating and non-depositing. By this invention it was discovered that normal glass bead cleaning procedures will alter the surface of metal coupon samples in a manner that provides resistance to coking.

Although not wishing to be bound to any particular theory, it is believed that the glass bead cleaning procedure does in fact deposit a surface layer of silicon containing metal that resists coking. It is believed that this silicon metal containing surface is most likely comprised of silica. Auger Electron Spectroscopy revealed that glass bead treated metal coupons had acquired a surface layer of silica. Therefore, the unexpected deposition of this silica appears to impart the known coking resistance of silica layers. However, glass bead treating is viewed by many as providing unique characteristics to treated surfaces. Thus, the discovery of a silica layer on treated metal surfaces does not preclude the possibility that other effects of the glass bead cleaning contribute to its coke inhibiting benefits.

A particular advantage of the glass bead cleaning stems from its low cost and simplicity. In comparison to most chemical treatments, glass bead treatment costs much less. Moreover, simple equipment requirements and operational procedures make glass bead cleaning suitable for most field operations. Hence, hydrocarbon processing equipment can readily receive the glass bead cleaning procedure in almost any field or plant location.

Accordingly in one embodiment this invention is a method of forming a coke inhibiting coating on the metal surfaces of equipment susceptible to coke formation, comprising treating the metal surfaces by impact with glass bead materials comprising amorphous silicate oxides at atmospheric conditions for a sufficient time to produce a coke inhibiting layer on the surfaces having a thickness of at least 20 Å.

In another embodiment this invention is an improved method for inhibiting coke formation on the metal surfaces of equipment used in a process for the conversion of hydrocarbons that passes a feedstream containing hydrocarbons to a hydrocarbon conversion zone, contacts the feed stream at hydrocarbon conversion conditions in the hydrocarbon conversion zone, and recovers an effluent stream comprising hydrocarbons from the hydrocarbon conversion zone and exposes the metal surfaces of the equipment used to pass the feedstream, contact the feedstream or recover the effluent to conditions suitable for the formation of coke on metal surfaces. The improvement comprises treating at least a portion of the metal surfaces by impact with glass bead materials for a sufficient time to produce a coke inhibiting layer on the metal surfaces and contacting at least one of the feed stream or the effluent streams with the metal surfaces having the coke inhibiting layer.

Other objects, embodiments and details of this invention will be provided in the following detailed description of the invention.

BRIEF DESCRIPTION OF THE DRAWING

FIGURE is a graph of coke accumulation produced by a high severity coking test performed on various samples.

DETAILED DISCLOSURE OF THE INVENTION

The metal treatments used in the process of this invention can benefit any process that is susceptible to the formation of coke on the internal surfaces of the process equipment. Processes to which this invention are particularly useful include catalytic reforming, catalytic dehydrogenation and cyclization, and catalytic cracking. The degree of coke formation in the different processes may vary widely. However, the relative ease and the low cost of this process makes it useful even in processes where only mild coking has been found to occur.

The process has utility for any metal surface commonly used in the construction of reactors for high temperature hydrocarbon conversion. Such metallurgies include mild steel, high and low alloy steels and non-ferrous metallic alloys, however, mild steels and low chrome alloys are believed to obtain the most benefit from this invention. Other steels that may benefit from this treatment include high nickel chrome stainless steel, such as 304 and 316, as well as high alloy inconel or incoloy steels.

In the practice of this invention, all steel surfaces or only the steel surfaces most susceptible to coking can receive the glass bead treatment. The glass bead treatment of the steel surfaces is relatively simple. The only requirements of the treatment are impact of the surface with the glass beads with sufficient momentum and for a sufficient time to deposit a layer of silica on the surface of the metal. The ordinary methods employed for glass bead treatment appear wholly adequate for providing the necessary change to the surface of the metals to achieve the beneficial coke inhibiting advantages of this invention.

The specific requirements of the glass beads are well known by those practicing the cleaning of metal surfaces by glass beading. The glass beads are microbeads of ordinary glass—an inorganic mixture consisting primarily of amorphous silicate oxides. A majority of the particles in the glass bead mixture will ordinarily have a spherical shape. Impurities and foreign matter are routinely kept low in the ordinary glass bead medium. Suitable glass beads are available in a wide range of sizes, but preferably within a size range of from 700 to 50 microns, with beads in the range of 250 to 74 microns being preferred. The size range of the glass beads used in the treatment process will vary depending on the physical characteristics of the surfaces to be treated. For metal surfaces with a large number of discontinuities, smaller beads will more easily reach into crevices and places of limited access.

The application of the glass beads to a metal surface is characterized as a low energy process. Glass beads typically impact a metal surface by pressure propulsion from a blasting nozzle. The low energy requirements of the glass bead process allow the use of relatively low blasting pressures of from 10 to 100 psi with pressures of 10 to 60 psia being preferred. The usual technique is to impact the glass beads at an angle relative to the direction of the surface receiving treatment. Typically, a nozzle position of from 40°-60° from the surface of the material receiving treatment will minimize bounce-back and breakage of the beads. When using a blasting nozzle, the nozzle outlet is ordinarily positioned from 4 to 8 inches from the surface of the work. The beading process should be continued until a coke inhibiting layer is formed on the surface. Typically, this requires impact by the glass beads until a uniformly smooth surface is achieved.

As previously mentioned, Auger Electron Spectroscopy (AES) reveals that the glass bead treatment will produce a silica layer on the treated surface. The thickness of the silica surface layer is typically in a range of from 20 to 500 Å and more typically in a range of from 50 to 150 Å. Therefore, the glass beading should continue until the surface of the treated metal receives a uniform silica layer with a thickness of at least 20 Å and preferably a thickness of from 20 Å to 500 Å, and more preferably from 30 Å to 150 Å. The silica layer achieved by glass beading has more uniformity than that achieved by other methods.

The following examples further demonstrate the coke inhibiting advantages of the glass beaded metal surfaces.

EXAMPLE I

In one experiment, conventional sandblasting on a set of samples was compared to samples receiving glass bead treatment. A first set of metal coupons were sandblasted to achieve a uniformly contacted surface. For a comparison, another set of samples were exposed to the same blasting equipment with the same apparatus as used for the samples that received sandblasting, except that the sand used on the sandblasted samples was replaced with glass bead having a size of from 250 to 150 microns and a second set of glass beaded samples were obtained. AES analysis showed very poor and uneven silica deposition on the sandblasted samples as compared to an even silica layer on the glass beaded surfaces. Therefore, the particular use of glass beads for the blasting operation appears to be an important aspect of this invention.

EXAMPLE 2

In this experiment a set of three different metal coupon samples were prepared. Each coupon was 2"×½"×1/16". One set of the coupons was subjected to a glass bead blasting procedure, as previously described, to deposit a silica layer on to the metal surface. Another set of coupons received a sulfur treatment and a third set of coupons was left untreated. Each set of coupons consist of four different metal types having the chemical composition as described in Table 1. The coupons were exposed to reforming process conditions for about a week that included a pressure of 60 psig, a hydrogen to hydrocarbon ratio of 2, and a temperature of 950°-1000° F. Results of coupon inspection by visual examination and AES analysis are presented in Table 2.

TABLE 1

| Grade | Cr | Mo | Ni |
|---|---|---|---|
| F11 | 1.23 | 0.49 | — |
| F22 | 2.12 | 0.99 | 0.13 |
| F9 | 9.15 | 1.00 | 0.33 |
| Type 304 | 18.28 | 0.17 | 8.13 |

Table 2 clearly demonstrates the coke inhibiting properties of the surfaces receiving the glass beaded treatment. All of the glass beaded surfaces performed as well as the surfaces treated by the sulfur treatment.

EXAMPLE 3

The following test offers a more quantitative comparison of the effectiveness of glass bead treating under severe coking conditions. This test was conducted by placing sample coupons of a type hereinafter described in a holder enclosed within a heated and pressurized coupon chamber chamber that circulates a hydrocarbon containing stream and hydrogen so that the samples are exposed to coking conditions. During the test thermogravometric analysis equipment continuously monitors the weight of the sample to measure the amount of coke formation.

Four sample coupons were tested in the coupon chamber. One consisted of an F11 grade material having the composition given in table 1. A second coupon comprised the F11 material similar in all respect to the first coupon except that it was given a glass bead treatment. Two additional coupons comprising type 304 and type 321 stainless steels were also tested under severe coking conditions. Each rectanglular coupon was a nominal 0.25×5 inches with a thickness of about 1/16 of an inch. The testing passed a mixture of hydrogen and naphtha through the test chamber at the conditions listed in Table 3.

TABLE 3

| | |
|---|---|
| Naphtha Feed Rate | 9.2 gram/hr |
| Hydrogen/Naphtha Mole Ratio | 1.9 |
| Pressure | 50 psig |
| Temperature | 1000 deg. F. (538 C.) |
| Duration of Test | 24 hours |

The conditions of the test provided a severe coking environment in which all coupons were observed to gain weight. Test results graphically depicting the weight gain for all of the coupons based on the thermogravometric analysis measurements are shown in the FIGURE. Visual observation of the coupons after each test confirmed that the weight gain was due to coke accumulation. Sample coupons comprising the type 304 and type 321 stainless steels had the lowest weight gain for coke accumulation through the 24 hour test period. The untreated metal coupons comprising the low alloy metal had the highest accumulation of coke. Application of the glass bead treatment to the low chrome material reduced the wt % accumulation of coke over the 24 hour period from a 5.01 mass percent of accumulated coke for the untreated low chrome metal to 3.01 with the glass bead treatment. Thus the glass bead treatment reduced the coke accumulation relative to an untreated metal coupon by about 40%.

The test results show that the glass bead treatment significantly reduces the succeptibility of metal surfaces to form coke. Although the glass bead treatment did not reduce the coke accumulation for a low chrome material to a level matching the high coking resistance of the stainless steels, the simple glass bead treatment still offers a significant improvement and benefit to any low chrome material exposed to an environment that promotes coking.

Therefore, the glass bead treatment has been now found to provide a simple method of inhibiting coke formation on metal surfaces that is both inexpensive and easy to use. The glass bead treating offers significant reductions in coke formations and accumulation on metal surfaces at a fraction of the cost associated with the use of high alloy stainless steels. Moreover, the glass bead treatment provides a simple method that can replace the use of sulfur compounds to inhibit coking in hydrocarbon processes. The elimination of sulfur compounds is particularly advantageous in processes that are sensitive to sulfur poisoning.

TABLE 2

| | | Treatment | | |
|---|---|---|---|---|
| Coupon Grade | Cr Wt-% | None | Sulfur | Silica |
| F11 | 1.23 | X | 0 | 0 |
| F22 | 2.12 | X | 0 | 0 |
| F9 | 9.0 | X | 0 | 0 |
| 304 | 18.28 | 0 | 0 | 0 |

X = Significant Coke Accumulation
0 = No Significant Coking

What is claimed is:

1. A method of forming a coke inhibiting coating on the metal surfaces of equipment susceptible to coke formation, comprising treating said metal surfaces by impact with glass bead materials comprising amorphous silicate oxides at atmospheric conditions for a sufficient time to produce a coke inhibiting layer on said surfaces having a thickness of at least 20 Å.

2. The method of claim 1 wherein the substrate of said metal surface comprises an iron alloy.

3. The method of claim 2 wherein said iron alloy includes at least one of a molybdenum, chromium, and nickel metal.

4. The method of claim 1 wherein said glass bead material comprises spherical particles having a size in a range of from 700 to 50 microns.

5. The method of claim 1 wherein said glass bead materials are impacted with said metal surfaces by discharge from a blasting nozzle at a pressure of from about 10 to 100 psig.

6. The method of claim 1 wherein said impact with said glass beads deposits a layer of silica on said surface having a thickness of 20 to 500 Å.

7. An improved method for inhibiting coke formation on the metal surfaces of equipment used in a process for the conversion of hydrocarbons that passes a feedstream containing hydrocarbons to a hydrocarbon conversion zone, contacts said feedstream at hydrocarbon conversion conditions in said hydrocarbon conversion zone, and recovers an effluent stream comprising hydrocarbons from said hydrocarbon conversion zone and exposes the metal surfaces of the equipment used to pass said feedstream, contact said feedstream or recover said effluent to conditions suitable for the formation of coke on metal surfaces; wherein the improvement comprises treating at least a portion of said metal surfaces by impact with glass bead materials comprising amorphous silicate oxides for a sufficient time to produce a coke inhibiting layer having a thickness of at least 20 Å on said metal surfaces and contacting at least one of said feedstream or said effluent streams with said metal surfaces having said coke inhibiting layer.

8. The process of claim 7 wherein said hydrocarbon conversion conditions are suitable for catalytic reforming, dehydrogenation, cyclization or catalytic cracking.

* * * * *